United States Patent [19]

Jan Botes

[11] 4,252,474

[45] Feb. 24, 1981

[54] STABILIZATION OF ROCK FORMATIONS

[76] Inventor: Vernon Jan Botes, P.O. Box 89031, Lyndhurst. 2106, South Africa

[21] Appl. No.: 36,103

[22] Filed: May 4, 1979

[30] Foreign Application Priority Data

May 11, 1978 [ZA] South Africa ..... 78/2699
Jan. 10, 1979 [ZA] South Africa ..... 79/0117

[51] Int. Cl.[3] ..... E02D 3/12
[52] U.S. Cl. ..... 405/266; 405/269
[58] Field of Search ..... 405/259, 260, 258, 266, 405/267, 269, 303; 166/287, 285

[56] References Cited

U.S. PATENT DOCUMENTS

| | | | |
|---|---|---|---|
| 1,987,626 | 1/1935 | Klie | 405/266 |
| 2,080,406 | 5/1937 | Allen | 166/287 |
| 3,055,424 | 9/1962 | Allen | 166/285 |
| 3,379,016 | 4/1968 | Williams | 405/260 |
| 3,754,401 | 8/1973 | Lipow | 405/259 |
| 4,067,675 | 1/1978 | Hanson | 166/287 X |

*Primary Examiner*—Stephen J. Novosad
*Attorney, Agent, or Firm*—Karl W. Flocks

[57] ABSTRACT

A rock formation may be stabilized by introducing a settable stabilizing substance into boreholes around non-load bearing filler elements in the boreholes, and allowing the substance to set.

The use of filler elements reduces the volume of a settable substance needed in the holes. Thereby the cost is reduced because the filler elements may be of a less expensive material than the settable substance. Different types of filler elements are also disclosed.

8 Claims, 6 Drawing Figures

STABILIZATION OF ROCK FORMATIONS

BACKGROUND OF THE INVENTION (1) Field of the Invention

This invention relates to the stabilisation of a rock formation. More particularly the invention relates to a method of stabilising a rock formation and to apparatus for use in such method. The invention finds particular application in the stabilization of rock formations underground in mine excavations, where cracks or fissures in the rock formations can cause danger of dislodged rock segments.

(2) Description of the Prior Art

U.S. Pat. No. 2,667,037—Thomas et al, Jan. 26, 1954, discloses anchor bolts protected by grout which holds the bolts firmly in the rock strata and seals the bolts from atmosphere and hence inhibits corrosion and weakening of the bolts.

U.S. Pat. No. 3,222,873—Williams, Dec. 14, 1965, discloses the pumping of cementitious grout under pressure into the clearance space between an anchor bolt and the wall of the borehole. The patent is directed to a more efficient method of grouting.

Later patents, also in the name of Williams, are directed to different aspects of grouting anchor bolts in holes in rock formations. The Patents are:

U.S. Pat. No. 3,234,742 Feb. 15, 1966
U.S. Pat. No. 3,326,004 June 20, 1967
U.S. Pat. No. 3,379,016 Apr. 23, 1978
U.S. Pat. No. 3,415,066 Dec. 10, 1978.

U.S. Pat. No. 3,618,326—Nov. 9, 1971, in the name of Montgomery, reviews certain prior art directed to the use of resins instead of grout with anchor bolts in holes. The Montgomery patent itself is directed to a particular way in which the resin components are packed in a single package but with two compartments. In the Montgomery patent and in the prior art relevant to anchor bolts reviewed therein, it appears that resins are used as a substitute for grout, and that the resins perform no function other than to protect the bolts from corrosion and/or to locate the expansion shells of the bolts in position.

SUMMARY OF THE INVENTION

The applicant has found that generally load bearing members such as anchor bolts are not needed if holes are filled with a suitable settable stabilizing substance having sufficient tensile strength. Indeed, the applicant has found that the volume of substance required and hence the cost, may be substantially reduced by using non-load bearing filler elements in the holes. The filler elements carry no load and are used merely to take up space inside the holes thereby to reduce the volume of stabilizing substance needed. The filler elements therefore are not intended nor do they purport to support the rock formation. Such support is provided by the stabilizing substance after it has set. Accordingly, in this specification the term 'filler element' refers to an article having as its main function, that of a filler element, and in which any load bearing capacity or function which it may have, is secondary or negligible. The applicant therefore believes that rock formations can be stabilized in accordance with this invention, at less cost than with methods of which he is aware, as practised heretofore.

According to the invention there is provided a method of stabilizing a rock formation which method includes drilling a hole into the rock formation;

inserting a filler element into the hole and leaving a clearance space of annular cross section, in the hole around the filler element;

introducing a settable stabilizing fluid substance under pressure into the clearance space, so as to cause the substance to flow into any cracks or fissures in the rock formation and intersected by the hole; and thereupon allowing the stabilizing fluid substance to set.

If desired, the filler element may be withdrawn from the hole after the stabilizing fluid substance has set. The introduction of the stabilizing fluid substance under pressure, into the clearance space may take place by means of a charging tube having a discharge end accommodated within the clearance space around the filler element and engaging sealingly with the inner periphery of the hole. The charging tube may be gradually withdrawn as the clearance space and as such intersected cracks and fissures as there may be, fill up with the settable stabilizing fluid substance.

The invention extends also to a charging tube adapted for carrying out the method as described, the charging tube being adapted to receive a filler element within it, and having an inlet end adapted to admit the settable stabilizing fluid substance under pressure, and having a discharge end adapted to engage sealingly with the inner periphery of the hole. The charging tube may be of annular cross-section having concentric inner and outer walls. The outlet opening at the discharge end may be of annular shape, and the inner wall may be adapted to engage sealingly with the outer periphery of a filler element slidable within it.

The invention extends still further to a filler element which may be of synthetic plastics material. It may be of cylindrical shape which is receivable into the charging tube as described above, and may have a head portion adapted to provide an interference fit with the inside of the hole. The filler element may be of tubular shape and the head portion may be in the form of an upset end having a cupwasher-like shape.

The settable substance may be a suitable adhesive substance such as, for example, an epoxy resin. It may include an extender such as, for example, sand, particulate glass, tar or some other bituminous product.

BRIEF DESCRIPTION OF THE DRAWINGS

The invention will now be described in more detail, by way of example, with reference to the accompanying drawings.

In the drawings.

DESCRIPTION OF PREFERRED EMBODIMENTS

Figure 5:
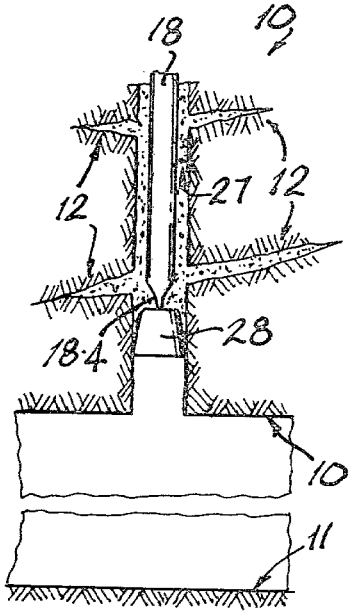
FIG. 5 shows a sectional elevation through a hole in a hanging wall after the hole has been charged with a settable stabilizing substance.

Referring now to the drawings, reference numeral 10 generally indicates the hanging wall of a mining excavation, and 11 indicates the footwall. (See FIG. 5). In the rock formation constituting the hanging wall 10 there are shown cracks or fissures 12 which occur naturally and which weaken the hanging wall.

To stabilize the hanging wall 10, a hole 14 is first drilled into the rock face. The hole may be drilled by making use of standard size drills used for drilling shot holes or holes for accommodating anchor roof bolts. Thus, the hole 14 will have a diameter of about 34 or 40 mm.

As a next step, the discharge end 16.1 of a charging tube 16, having a filler element 18 located therein, is inserted into the hole 14.

The discharge end 16.1 of the charging tube 16 is in the form of two concentric tubes 22.1 and 22.2 joined at their bottom ends and defining between them a passage 24 of annular cross section, which opens into an annular outlet opening or mouth 26 at the discharge end. The charging tube 16 further comprises a tube 16.2 which leads into the annular passage 24. The filler element 18 is in the form of a length of plastics tubing which is closed at its opposite ends 18.1 and 18.2. The filler element 18 can be accommodated freely within the inside of the inner tube 22.2.

After the charging tube 16 with the filler element 18 therein has been inserted into the hole 14, a settable epoxy resin 20 is introduced through the tube 16.2 into the annular space 24, and out of the outlet opening 26 into the clearance space 27 around the filler element 18 in the hole 14. From there it flows into the cracks or fissures 12. As the settable epoxy resin is being pumped into the hole 14, the charging tube 16 is gradually withdrawn from the hole 14. The filler element 18 has a head portion at its upper end 18.1 which has a plurality of radially outwardly protruding resilient fingers 19 which are adapted to engage frictionally with the side wall of the hole 14.

Once the discharge conduit 16 has been withdrawn entirely from the hole, a plug 28 may be pushed into the mouth of the hole so as to seal off the hole.

The epoxy resin used may be an epoxy resin known by the trade name "EPIDERMIX". It may be pumped out of the outlet opening 26 by introducing a suitable quantity into the discharge conduit 16 and then connecting the inlet end of the tube 16.2 to a supply of compressed air. The compressed air will then expel the resin from the discharge conduit via the mouth 26, at the same time cleaning out the discharge conduit.

Thereafter, the epoxy resin in the hole 14 may be allowed to set. The filler element 18, because of its relatively low cost, may be left permanently in place.

It is an advantage of this invention that substantially less epoxy resin is required than would be the case if the filler 18 had not been used. This leads to a saving in cost because the filler element can be much less expensive than the epoxy resin. The amount of epoxy resin required may be reduced even further by mixing it with an extender such as sand or particulate glass. The radial thickness of the clearance space 27 between the filler element and the wall of the cavity may be made as thin as is practically possible. It may be 4 mm thick, but could be thicker. The greater the volume of the clearance space, the more settable material will be needed in the hole.

Figure 1:
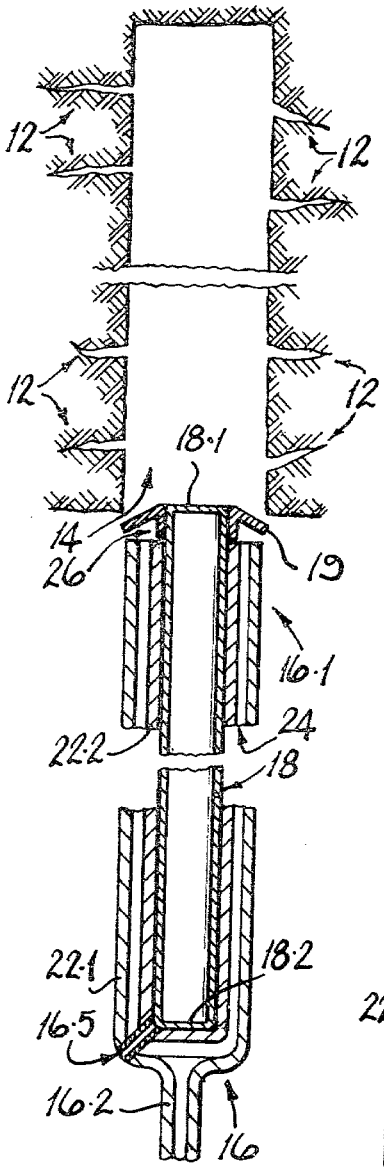
FIG. 1 shows a sectional elevation through a hole in the hanging wall of a rock formation, and shows in axial section a charging tube with a filler element ready for insertion into the hole, as a first step in stabilizing the hanging wall in the method according to the invention.
Figure 2:
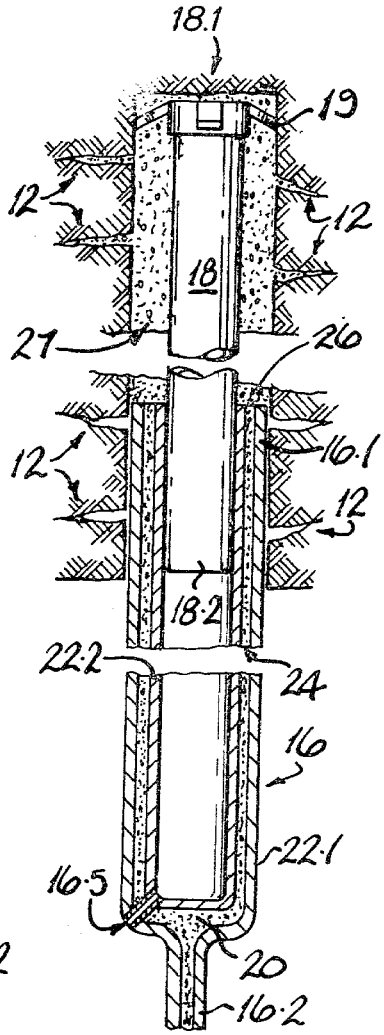
FIG. 2 shows a sectional elevation similar to FIG. 1, showing a subsequent step in the stabilization of the hanging wall.
Figure 3:
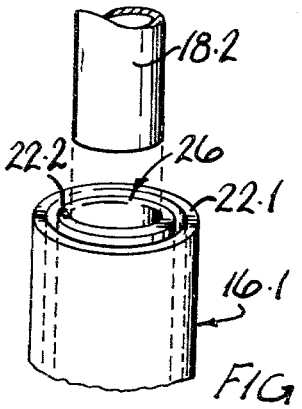
FIG. 3 shows a three dimensional view of the lower end portion of the filler element and the outlet opening at the discharge end of the charging tube.
Figure 4:
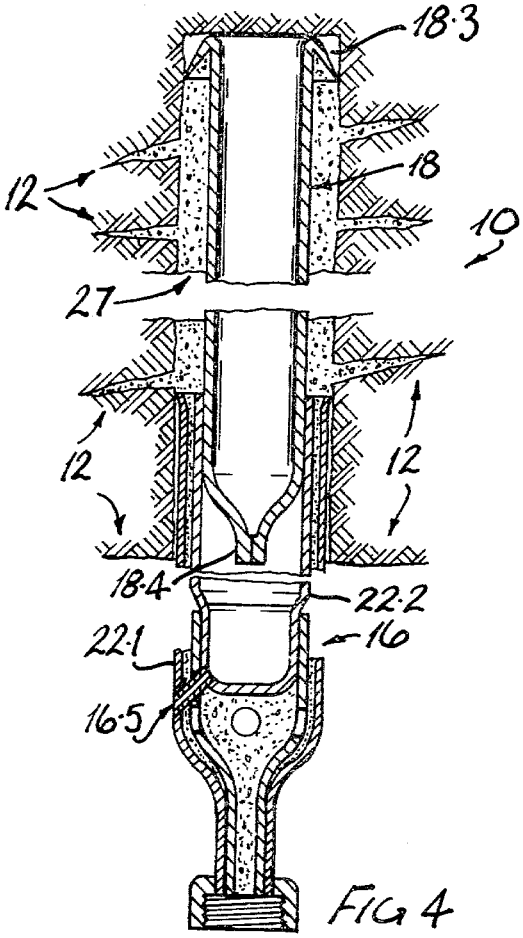
FIG. 4 shows a view similar to FIG. 2 but with another type of filler element, and a charging tube of alternative construction.

Referring now to FIG. 4 of the drawings, the arrangement is generally similar to that shown for FIG. 2. The filler element of FIG. 4 is however different in that the head portion 18.3 is of cupwasher-like shape which engages sealingly with the inner surface of the hole 14.

The charging tubes 16 are provided with air bleed passages 16.5 to admit air into the inner tube 22.2 when the tube 16 is withdrawn from the hole 14 and when the filler element 18 is left in the hole 14.

Figure 6:
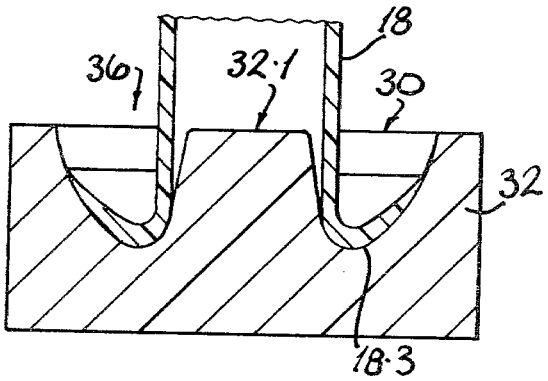
FIG. 6 shows an axial section through a die and filler element head portion formed in the die.

Referring now to FIG. 6 of the drawings there is shown a method of upsetting the one end of a filler element 18 to form a cupwasher-like head portion, by pushing the end into the recess 30 of a suitable shaped die 32 when the die has been heated to a temperature above the melting temperature of the plastics material of which the filler element 18 is made. Before the end of the filler element 18 is pushed into the recess 30, the spigot end 32.1 of the die will project about half its length into the end of the filler element 18. Pushing of the element 18 in the direction of arrow 36 will then result in the belling out of that end to form a head portion 18.3 of cupwasher-like shape, as shown in the drawing.

As soon as the cupwasher shape has reached its desired overall diameter, then the filler element is withdrawn from the die, and the head end 18.3 is allowed to cool down and to set. Thereupon, if desired, the other end can be closed off, as indicated at 18.4 by merely pinching the end between a pair of heated dies.

What I claim is:

1. A method of stabilizing a rock formation, which method includes drilling a hole into the rock formation;

inserting a filler element into the hole and leaving a clearance space of annular cross-section in the hole around the filler element;

introducing a settable stabilizing fluid substance under pressure into the clearance space, so as to cause the substance to flow into any cracks for fissures in the rock formation and intersected by the hole; and thereupon allowing the stabilizing fluid substance to set;

the introduction of the stabilizing fluid substance under pressure, into the clearance space taking place by means of a charging tube having a discharge end accommodated within the clearance space around the filler element and engaging sealingly with the inner periphery of the hole; and the charging tube being gradually withdrawn as the clearance space and as such intersected cracks and fissures as there may be, fill up with the settable stabilizing fluid substance.

2. A method of stabilizing a rock formation, which method includes drilling a hole into the rock formation;

inserting a filler element into the hole and leaving a clearance space of annular cross-section in the hole around the filler element;

introducing a settable stabilizing fluid substance under pressure into the clearance space, so as to cause the substance to flow into any cracks or fissures in the rock formation and intersected by the hole; and thereupon allowing the stabilizing fluid substance to set;

the filler element having a body portion and a head portion of larger cross-sectional dimensions than the body portion, the head portion engaging sealingly with the inner periphery of the hole; and the internal pressure in the settable stabilizing fluid substance urging the head portion of the filler element in a direction towards the inner end of the hole.

3. A method as claimed in claim 2, in which the filler element is tubular, and in which the head portion is in the form of an upset end having a cupwasher-like shape.

4. A method of stabilizing a rock formation, which method includes drilling a hole into the rock formation;

inserting a filler element into the hole and leaving a clearance space of annular cross-section in the hole around the filler element;

introducing a settable stabilizing fluid substance under pressure into the clearance space, so as to cause the substance to flow into any cracks or fissures in the rock formation and intersected by the hole; and thereupon allowing the stabilizing fluid substance to set;

the filler element having a body portion and a head portion having an interference fit with the inner periphery of the hole for supporting the filler element in the hole, and the head portion being removably detachable from the body portion, and the body portion being detached from the head portion and withdrawn from the hole after the settable stabilizing fluid substance has set.

5. A charging tube adapted for use in introducing a settable stabilizing fluid substance under pressure, into a clearance space of annular cross-section around a filler element in a hole in a rock formation, the charging tube being adapted to receive the filler element within it, and having an inlet end adapted to admit the settable stabilizing fluid substance under pressure, the charging tube having also a discharge end adapted to enter into the clearance space around the filler element, the discharge end being adapted to engage sealingly with the inner periphery of the hole when the charging tube, in use, is gradually withdrawn from the hole while the filler element remains behind in the hole.

6. A charging tube as claimed in claim 5, which is of annular cross-section having concentric inner and outer walls, and which has an outlet opening of annular shape at the discharge end, and in which the inner wall is adapted to engage sealingly with the outer periphery of a filler element slidable within it.

7. A filler element which is of cylindrical tubular shape, and which has a cylindrical body portion and a head portion adapted to provide a sealing interference fit with the inside of the hole the head portion being in the form of an upset end having a cupwasher-like shape, and the filler element being receivable into a hole drilled into a rock formation and into a charging tube adapted, in use, to discharge a settable fluent substance into the hole around the tubular filler element.

8. A filler element as claimed in claim 7, in which the cylindrical body portion is adapted in use to engage sealingly with the charging tube as the hole fills up with settable fluent substance and as the charging tube is withdrawn from the hole.

* * * * *